US009574774B2

(12) United States Patent
Kobayashi

(10) Patent No.: US 9,574,774 B2
(45) Date of Patent: Feb. 21, 2017

(54) HEATER AND IGNITION APPARATUS EQUIPPED WITH THE HEATER

(71) Applicant: KYOCERA Corporation, Kyoto-shi, Kyoto (JP)

(72) Inventor: Akio Kobayashi, Kyoto (JP)

(73) Assignee: Kyocera Corporation, Kyoto (JP)

( * ) Notice: Subject to any disclaimer, the term of this patent is extended or adjusted under 35 U.S.C. 154(b) by 78 days.

(21) Appl. No.: 14/666,700

(22) Filed: Mar. 24, 2015

(65) Prior Publication Data

US 2015/0276222 A1 Oct. 1, 2015

(30) Foreign Application Priority Data

Mar. 27, 2014 (JP) ..... 2014-065387
Aug. 1, 2014 (JP) ..... 2014-157832

(51) Int. Cl.
*H05B 1/02* (2006.01)
*F23Q 7/22* (2006.01)

(52) U.S. Cl.
CPC ..... *F23Q 7/22* (2013.01)

(58) Field of Classification Search
CPC ..... F23Q 7/22; F23Q 7/001; F23Q 7/004; F23Q 7/10; H05B 1/0236; H05B 1/02; H05B 3/0072
USPC ..... 219/202, 205, 497, 494, 270, 260, 262, 219/263
See application file for complete search history.

(56) References Cited

U.S. PATENT DOCUMENTS 6,084,221 A * 7/2000 Natsuhara ..... H05B 3/141 219/216
7,982,166 B2 * 7/2011 Kukino ..... B28B 11/242 219/541
2005/0284859 A1 * 12/2005 Konishi ..... F23Q 7/001 219/270
2011/0114622 A1 * 5/2011 Sekiguchi ..... F23Q 7/001 219/270
2013/0248508 A1 * 9/2013 Ito ..... F23Q 7/001 219/270

FOREIGN PATENT DOCUMENTS

JP 2004-342622 A 12/2004

* cited by examiner

*Primary Examiner* — Mark Paschall
(74) *Attorney, Agent, or Firm* — Volpe and Koenig, P.C.

(57) ABSTRACT

Quick ignition of gaseous fuel in a heater is accomplished. There is provided a heater including an insulating substrate having a rectangular prism shape; and a heat-generating resistor disposed inside the insulating substrate so as to extend a longitudinal direction thereof, the insulating substrate being warped.

7 Claims, 12 Drawing Sheets

HEATER AND IGNITION APPARATUS EQUIPPED WITH THE HEATER

BACKGROUND OF THE INVENTION

1. Field of the Invention

The present disclosure relates to a heater comprising an insulating substrate and a heat-generating resistor mounted inside the insulating substrate, and an ignition apparatus equipped with the heater.

2. Description of the Related Art

As a heater for use in a gas range, a vehicle-mounted heating system, an oil fan heater, a glow plug for automotive engine, or others, a heater disclosed in Japanese Unexamined Patent Publication JP-A 2004-342622 can be cited by way of example. The heater disclosed in JP-A 2004-342622 comprises an insulating substrate and a heat-generating resistor embedded in the insulating substrate.

SUMMARY OF THE INVENTION

There is provided a heater which is capable of quick ignition of a gaseous fuel.

A heater in accordance with one embodiment of the disclosure comprises an insulating substrate having a rectangular prism shape, and a heat-generating resistor disposed inside the insulating substrate so as to extend in a longitudinal direction thereof, the insulating substrate being warped.

According to the heater in accordance with one embodiment of the disclosure, gaseous fuel ignition can be effected quickly.

DETAILED DESCRIPTION

Hereinafter, a heater in accordance with a first example of the disclosure will be described with reference to the drawings.

Figure 1:
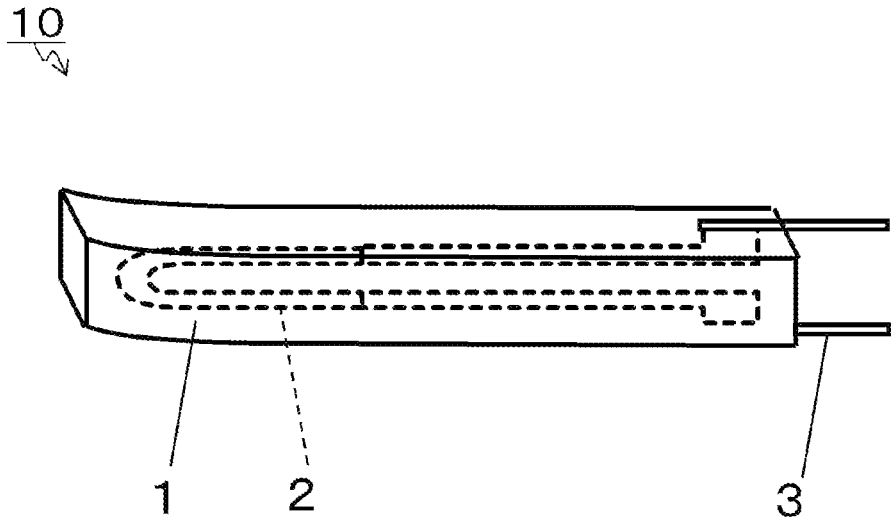
FIG. 1 is a perspective view showing a heater of a first example of the disclosure.

As shown in FIG. 1, the heater 10 in accordance with the first example of the disclosure comprises: an insulating substrate 1 constructed of a laminate of a plurality of insulating layers; and a heat-generating resistor 2 disposed in an interlayer of the insulating substrate 1 (hereafter also referred to as "the first heat-generating resistor 2"). The heater 10 can be used for, for example, a glow plug for automotive engine, a gas range, or others.

The insulating substrate 1 is an insulating member within which the first heat-generating resistor 2 is embedded. The insulating substrate 1 is constructed of a laminate of a plurality of ceramic layers which are insulating layers. The placement of the first heat-generating resistor 2 in the interior of the insulating substrate 1 helps improve the environmental durability of the first heat-generating resistor 2. The insulating substrate 1 is a rectangular prism-like member in the general shape of a rod or a plate, for example. As employed herein, the term "rectangular prism-like member" refers to a member having substantially the shape of a rectangular prism, wherefore the member does not necessarily have to have an exact rectangular-prism shape in a strict sense. Specifically, a part of the member which corresponds to a corner of the rectangular-prism shape can be rounded. Moreover, as will hereafter be described in detail, since the insulating substrate 1 of the disclosure is warped, it follows that the insulating substrate 1 does not have an exact rectangular-prism shape in a strict sense.

The insulating substrate 1 is made of electrically insulating ceramics such for example as oxide ceramics, nitride ceramics, or carbide ceramics. Specifically, the insulating substrate 1 is made of alumina ceramics, silicon nitride ceramics, aluminum nitride ceramics, silicon carbide ceramics, or the like.

An insulating substrate 1 made of silicon nitride ceramics can be obtained in the following manner. Specifically, for example, as sintering aids, a rare-earth element oxide such as $Y_2O_3$, $Yb_2O_3$, $Er_2O_3$, or the like in an amount of 5 to 15% by mass, $Al_2O_3$ in an amount of 0.5 to 5% by mass, and $SiO_2$ in an amount adjusted so that the amount of $SiO_2$ contained in a resultant sintered product will be 1.5 to 5% by mass are mixed in silicon nitride which is a main component. Then, the mixture is, after being molded into a predetermined shape, fired at a temperature in a range of 1650 to 1780° C. In this way, the insulating substrate 1 made of silicon nitride ceramics can be obtained. For example, a hot-pressing firing technique can be adopted for use in the firing operation.

In a case where the insulating substrate 1 has the shape of a rod-like rectangular prism, the length of the insulating substrate 1 is set in a range of 20 to 100 mm, for example. Moreover, the thickness of the insulating substrate 1 is set in a range of 1 to 6 mm, and the width thereof is set in a range of 2 to 40 mm.

The first heat-generating resistor 2 is a member which produces heat under voltage application. The first heat-generating resistor 2 is disposed in the interlayer of the insulating substrate 1. Upon application of a voltage to the first heat-generating resistor 2, an electric current flows therethrough, thereby causing the first heat-generating resistor 2 to produce heat. As the thereby produced heat is transmitted through the interior of the insulating substrate 1, a surface of the insulating substrate 1 is subjected to a high temperature. Then, the heat is transferred from the surface of the insulating substrate 1 to an object to be heated, whereupon the heater 10 becomes operable. As the to-be-heated object to which is transferred heat from the surface of the insulating substrate 1, a gaseous fuel obtained by gasification of light oil, a natural gas, a propane gas, or the like can be taken up as an example.

Both ends of the first heat-generating resistor 2 are led out to a side face of one end of the insulating substrate 1. For example, the first heat-generating resistor 2 has a folded form when viewed in section. Specifically, the first heat-generating resistor 2 is composed of two substantially parallel linear parts, and a connecting part acting as the connection between the two linear parts in the form of a bend whose outer periphery and inner periphery have a substantially semi-circular or semi-elliptical shape. The bend of the first heat-generating resistor 2 is located near the other end of the insulating substrate 1. The entire length of the first heat-generating resistor 2 is set in a range of 10 to 50 mm, for example.

The first heat-generating resistor 2 is composed predominantly of a carbide, a nitride, a silicide, or the like of, for example, tungsten (W), molybdenum (Mo), or titanium (Ti). In a case where the insulating substrate 1 is made of silicon nitride ceramics, it is preferable that the first heat-generating resistor 2 is composed predominantly of tungsten carbide. In this case, a coefficient of thermal expansion of the first heat-generating resistor 2 can be approximated to a coefficient of thermal expansion of the insulating substrate 1.

A first lead terminal 3 is a member for providing electrical connection between an external power supply and the first heat-generating resistor 2. The first lead terminal 3 is a rod-like member made of, for example, nickel or copper. The first lead terminal 3 is joined to a part of the first heat-generating resistor 2 which is led out to the surface of the insulating substrate 1 by a Ag—Cu brazing material.

In the heater 10 of the disclosure, the insulating substrate 1 is warped. In the presence of warpage in the insulating substrate 1, when the insulating substrate 1 is sprayed with a gaseous fuel, it is possible to impart directional motion to the gaseous fuel flowing in the vicinity of the surface of the insulating substrate 1, as well as to cause a flow such as to mix the gaseous fuel and oxygen together in the vicinity of the surface of the insulating substrate 1. As a result, the gaseous fuel and oxygen can coexist at a suitable ratio in the vicinity of the surface of the insulating substrate 1, wherefore the gaseous fuel can be ignited quickly.

Moreover, it is preferable that the insulating substrate 1 is made of silicon nitride ceramics. In this case, even if soot adheres to the surface of the insulating substrate 1, the adherent soot can be removed easily. This helps prevent accumulation of soot on the surface of the insulating substrate 1. Specifically, soot can be burned off by raising the temperature of the surface of the insulating substrate 1 rapidly up to 600° C. or above. In general, rapid elevation of the temperature of the surface of the insulating substrate 1 up to 600° C. or above results in the possibility of arising cracking or other trouble. In this regard, by forming the insulating substrate 1 of silicon nitride ceramics having high resistance to thermal shock, it is possible to suppress occurrence of cracking in the insulating substrate 1 entailed by rapid temperature elevation.

Moreover, an ignition apparatus using the heater 10 of the disclosure comprises the heater 10 thus far described and a flow channel for passing a gaseous fuel toward a warped surface of the insulating substrate 1. The ignition apparatus, being provided with the aforestated heater, necessitates shorter time for ignition. As employed herein, the term "warped surface" refers to either of a surface which has been convexly curved in its entirety as the result of deformation (hereafter also referred to as "convexly curved surface") and a surface which has been concavely curved in its entirety as the result of deformation (hereafter also referred to as "concavely curved surface"). The reason for that will be described by way of exemplification.

Figure 2:
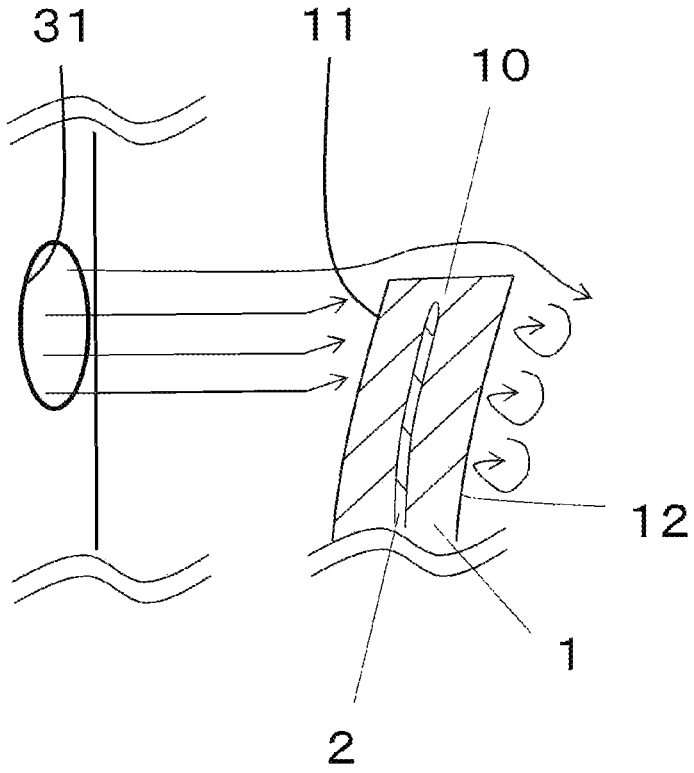
FIG. 2 is a fragmentally sectional view of the heater shown in FIG. 1.

As the first example, there is described a case as shown in FIG. 2 in which the insulating substrate 1 is warped in a longitudinal direction thereof, and a convexly curved surface 11 is sprayed with a gaseous fuel. In FIG. 2, arrows indicate the flow of the gaseous fuel (this holds true for FIGS. 4 to 6 as will hereafter be cited). As shown in FIG. 2, the gaseous fuel sprayed on the convexly curved surface 11 travels toward the outer periphery of the convexly curved surface 11 while flowing toward a concavely curved surface 12. At this time, the gaseous fuel flows toward the concavely curved surface 12 while entraining oxygen existing in the vicinity of the convexly curved surface 11. Then, in response to the flow of the gaseous fuel and the entrained oxygen, in the vicinity of the surface of the concavely curved surface 12, oxygen existing in the vicinity of the concavely curved surface 12 is caused to flow vortically. Upon entrainment of the gaseous fuel flowing from the convexly curved surface 11 in this vortex flow, the gaseous fuel and oxygen can coexist at a suitable ratio in the vicinity of the concavely curved surface 12. This makes it possible to achieve quick gaseous fuel ignition.

Moreover, since the insulating substrate 1 is warped in the longitudinal direction thereof, it follows that the vortex flow tends to occur readily at each end of the insulating substrate 1 in the longitudinal direction thereof. Note that, in this example, the bend of the first heat-generating resistor 2 is located near the other end of the insulating substrate 1, wherefore the heater 10 is subjected to the highest temperature in a region near the other end of the insulating substrate 1. Thus, since the gaseous fuel and oxygen can coexist at a suitable ratio in the vicinity of the region where the heater 10 is subjected to the highest temperature, it is possible achieve gaseous fuel ignition more quickly.

Figure 3:
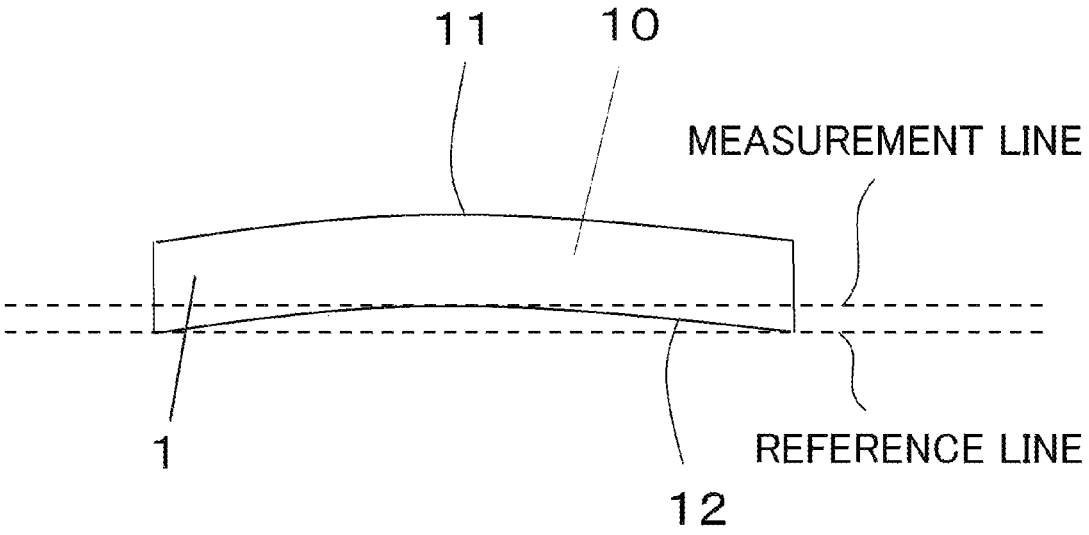
FIG. 3 is a schematic view for illustrating a method of measuring an amount of warpage of an insulating substrate.

Examples of methods for forming a warped insulating substrate 1 include a grinding process. The amount of warpage of the insulating substrate 1 can be checked by the following technique, for example. As shown in FIG. 3, measurement is conducted by monitoring the insulating substrate in a direction perpendicular to the warpage-bearing surface (the convexly curved surface 11 or the concavely curved surface 12) with use of a projector. More specifically, a line connecting the ends of the convexly curved surface 11 or concavely curved surface 12 is drawn (hereafter also referred to as "the reference line"), and also, a line parallel to the reference line is drawn so as to run a point corresponding to a part of the warped surface which lies farthest away from the reference line in a direction perpendicular to the reference line (hereafter also referred to as "the measurement line"). The amount of warpage (the size of warpage) can be determined by measuring a spacing between the reference line and the measurement line. In FIG. 3, there is shown a case where a measurement line for determining the amount of warpage of the concavely curved surface 12 is drawn with respect to a line connecting the ends of the concavely curved surface 12 which is defined as the reference line. In a case where the insulating substrate 1 is shaped like a rectangular prism which is 4 mm in width, 2 mm in thickness, and 40 mm in length, then the size of warpage can be set in a range from about 2 μm to 2 mm, for example.

At this time, in a case where the insulating substrate 1 is warped in the longitudinal direction thereof as shown in FIG. 2, and the gaseous fuel is sprayed toward the convexly curved surface 11, it is preferable to place the heater 10 in the following manner. That is, as shown in FIG. 2, the heater 10 is inclined so that its outer periphery is situated at a longer distance, whereas its midportion is situated at a shorter distance, as seen from a gaseous fuel ejection hole 31. In so doing, when the convexly curved surface 11 is sprayed with the gaseous fuel, the gaseous fuel is allowed to travel smoothly toward the outer periphery of the convexly curved surface 11. Accordingly, the gaseous fuel flows smoothly toward the concavely curved surface 12 while entraining oxygen existing in the vicinity of the convexly curved surface 11. As a result, oxygen existing in the vicinity of the concavely curved surface 12 is readily caused to flow vortically. This makes it possible to achieve gaseous fuel ignition more quickly. Preferably, a part of the convexly curved surface 11 which is sprayed with the gaseous fuel is inclined at an angle of 1 to 20°, for example, with respect to a direction perpendicular to a gaseous-fuel ejection direction.

If the angle of inclination exceeds 20°, the gaseous fuel will tend to flow obliquely rearward of the heater 10. With this in view, by setting the inclination angle to be smaller than or equal to 20°, the gaseous fuel is allowed to flow smoothly in the vicinity of the concavely curved surface 12. This helps facilitate gaseous fuel ignition.

Figure 4:
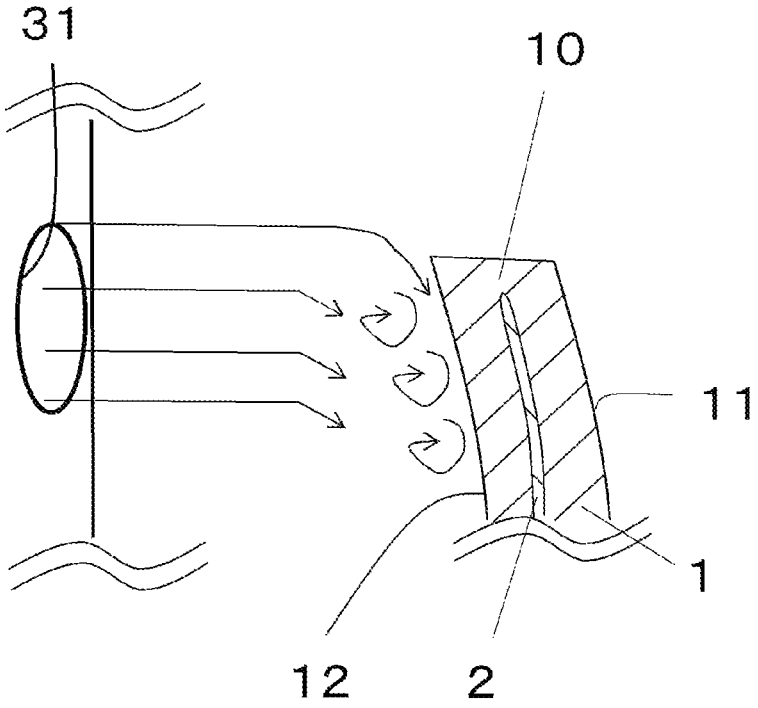
FIG. 4 is a sectional view showing the heater of a second example of the disclosure.

As a second example, there is described a case as shown in FIG. 4 in which the insulating substrate 1 is warped in the longitudinal direction thereof as is the case with the first example, but a gaseous fuel is sprayed on the concavely curved surface 12 instead of the convexly curved surface 11. As shown in FIG. 4, the gaseous fuel sprayed on the concavely curved surface 12 is caused to flow vortically while entraining oxygen in the vicinity of the concavely curved surface 12, with the consequence that the gaseous fuel and oxygen can coexist at a suitable ratio in the vicinity of the concavely curved surface 12. This makes it possible to achieve quick gaseous fuel ignition.

At this time, in a case where the insulating substrate 1 is warped in the longitudinal direction thereof as shown in FIG. 4, and the gaseous fuel is sprayed toward the concavely curved surface 12, it is preferable to place the heater 10 in the following manner. That is, as shown in FIG. 4, the heater 10 is inclined so that its outer periphery is situated at a shorter distance, whereas its midportion is situated at a longer distance, as seen from the gaseous fuel ejection hole 31. In so doing, when the concavely curved surface 12 is sprayed with the gaseous fuel, the gaseous fuel is allowed to travel smoothly toward the inner periphery of the concavely curved surface 12. Accordingly, the gaseous fuel is readily caused to flow vortically while entraining oxygen existing in the vicinity of the concavely curved surface 12. This makes it possible to achieve gaseous fuel ignition more quickly. Preferably, a part of the concavely curved surface 12 which is sprayed with the gaseous fuel is inclined at an angle of 1 to 10°, for example, with respect to a direction perpendicular to a gaseous-fuel ejection direction. In this case, the gaseous fuel is caused to flow vortically more readily.

In a case where the insulating substrate 1 is shaped like a rectangular prism which is 4 mm in width, 2 mm in thickness, and 40 mm in length, then the size of warpage can be set in a range from about 2 μm to 2 mm, for example.

Figure 5:
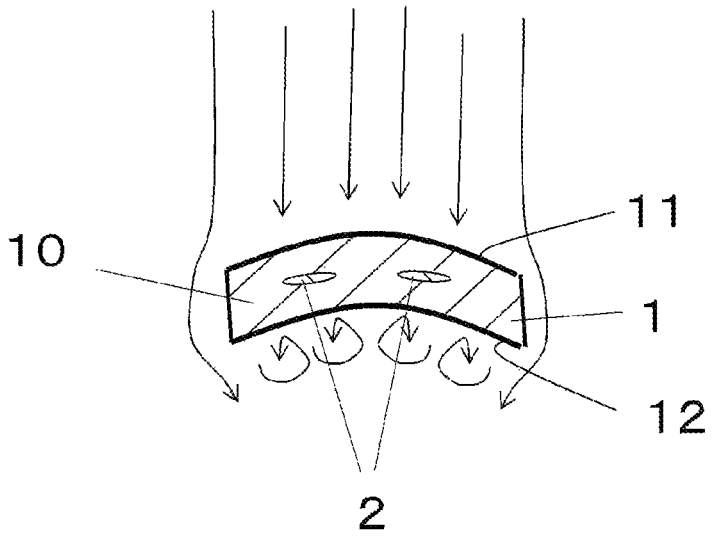
FIG. 5 is a sectional view showing the heater of a third example of the disclosure.

As a third example, there is described a case as shown in FIG. 5 in which the insulating substrate 1 is warped in a width direction thereof, and a resultant convexly curved surface 11 is sprayed with a gaseous fuel. As shown in FIG. 5, the gaseous fuel sprayed on the convexly curved surface 11 travels toward the outer periphery of the convexly curved surface 11 while flowing toward another surface 12 which has resultantly been concavely curved (concavely curved surface 12). At this time, the gaseous fuel flows toward the concavely curved surface 12 while entraining oxygen existing in the vicinity of the convexly curved surface 11. Then, in response to the flow of the gaseous fuel and the entrained oxygen, in the vicinity of the surface of the concavely curved surface 12, oxygen existing in the vicinity of the concavely curved surface 12 is caused to flow vortically. Upon entrainment of the gaseous fuel flowing from the convexly curved surface 11 in this vortex flow, the gaseous fuel and oxygen can coexist at a suitable ratio in the vicinity of the concavely curved surface 12. This makes it possible to achieve quick gaseous fuel ignition.

Moreover, by warping the insulating substrate 1 in the width direction thereof, it is possible to cause a vortex flow around the insulating substrate 1 in either of a case where the gaseous fuel is sprayed on both ends of the insulating substrate 1 and a case where the gaseous fuel is sprayed on the midportion of the insulating substrate 1 when the insulating substrate 1 is viewed in the longitudinal direction thereof. Accordingly, ignition can be achieved successfully regardless of gaseous fuel spraying position in the insulating substrate 1, with consequent simplification in proper positioning of the heater 10 in use.

In a case where the insulating substrate 1 is shaped like a rectangular prism which is 4 mm in width, 2 mm in thickness, and 40 mm in length, then the size of warpage can be set in a range from about 2 μm to 1 mm, for example.

Figure 6:
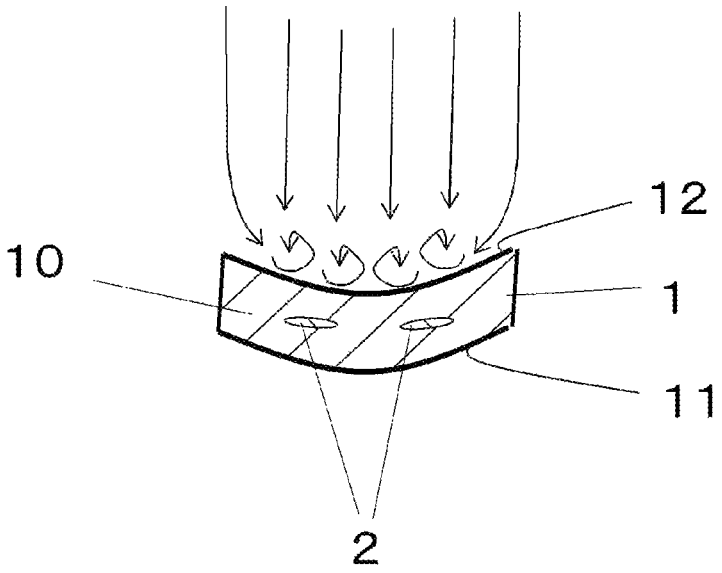
FIG. 6 is a sectional view showing the heater of a fourth example of the disclosure.

As a fourth example, there is described a case as shown in FIG. 6 in which the insulating substrate 1 is warped in the width direction thereof as is the case with the third example, but a gaseous fuel is sprayed on the concavely curved surface 12 instead of the convexly curved surface 11. As shown in FIG. 6, the gaseous fuel sprayed on the concavely curved surface 12 is caused to flow vortically while entraining oxygen in the vicinity of the concavely curved surface 12, with the consequence that the gaseous fuel and oxygen can coexist at a suitable ratio in the vicinity of the concavely curved surface 12. This makes it possible to achieve quick gaseous fuel ignition.

In a case where the insulating substrate 1 is shaped like a rectangular prism which is 4 mm in width, 2 mm in thickness, and 40 mm in length, then the size of warpage can be set in a range from about 2 μm to 1 mm, for example.

Figure 7:
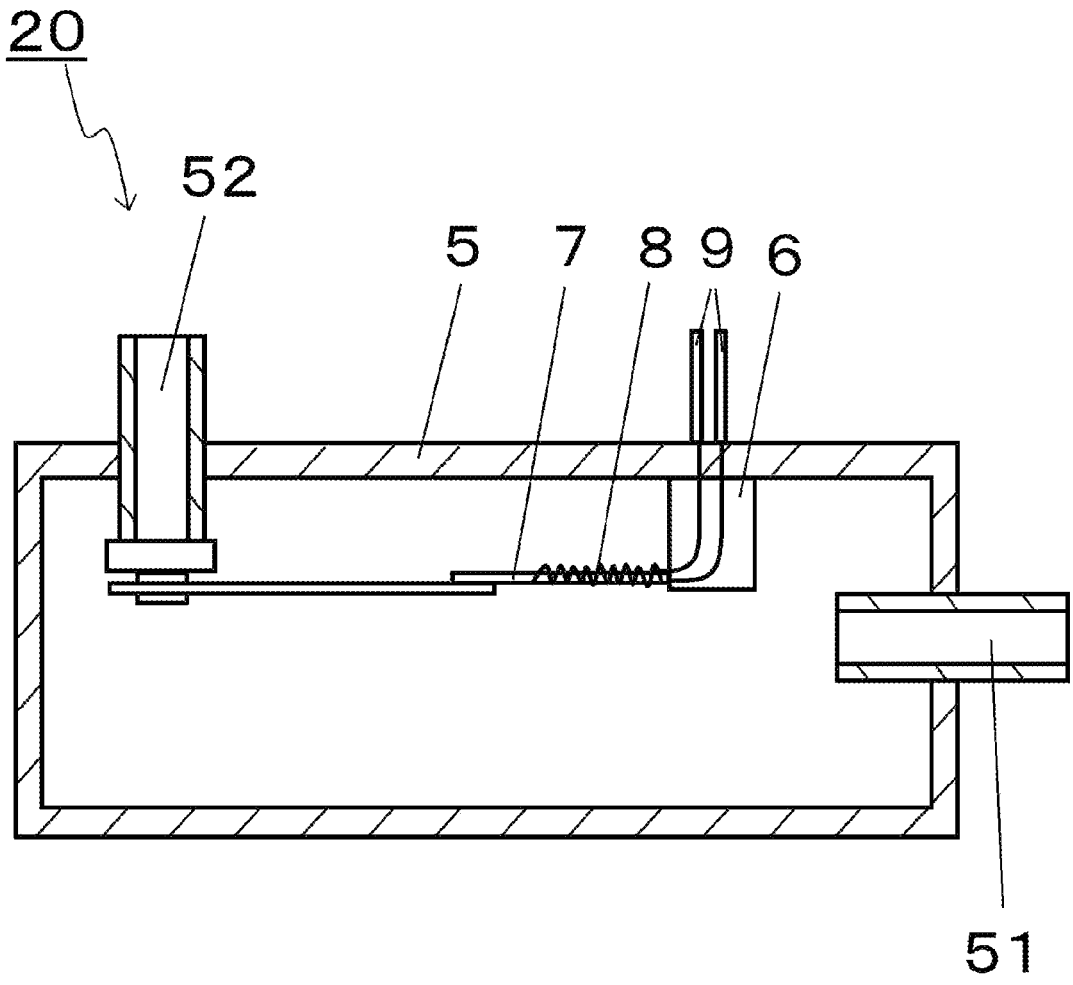
FIG. 7 is a sectional view showing a gas valve which constitutes an ignition apparatus.

Next, a description will be given as to an example of a valve for adjustment of gaseous fuel supply which is provided in the ignition apparatus. As such a valve, a gas valve 20 as shown in FIG. 7 can be taken up as an example. As shown in FIG. 7, the gas valve 20 comprises: a casing 5; a mount member 6 disposed inside the casing 5; a thermal valve 7 attached to the mount member 6; a second heat-generating resistor 8 disposed on the thermal valve 7; and second lead terminals 9 connected to the second heat-generating resistor 8. The gas valve 20 is a member for spraying a gaseous fuel on the heater 10.

The casing 5 is a member having a cavity therein for the passage of a gaseous fuel. The casing 5 has two holes for providing communication between the internal cavity and the exterior thereof. One of the two holes serves as an admission port 51 into which a gaseous fuel is admitted from outside the casing. The other one of them serves as a supply port 52 through which a gaseous fuel is fed from the interior of the casing 5 to an externally disposed heater (not shown). The casing 5 is given a rectangular prism-like outer shape, for example. In this example, one side face of the casing is formed with the admission port 51, and, the supply port 52 is formed in a part of one main surface adjacent to the one side face which part is located far away from the admission port 51. The casing 5 is made of a metal material such as steel or aluminum. The casing 5 is, so long as it is shaped like a rectangular prism for example, designed so that the length of the longer side of a main surface is 80 mm; the length of the shorter side thereof is 20 mm; and the length of a side of a side face that is perpendicular to the main surface is 30 mm.

The mount member 6 is a member for installation of the thermal valve 7. The mount member 6 is disposed on, out of inner peripheral surfaces of the casing 5, an inner peripheral surface formed with the supply port 52. The mount member 6 is shaped like a rectangular prism, for example. The mount member 6 is made of an insulating material such for example as oxide ceramics or nitride ceramics.

The thermal valve 7 is a valve for closing and opening the supply port 52 of the casing 5. The thermal valve 7 is formed of a plate-like bimetal such as an iron-copper bimetal or an iron-nickel bimetal. More specifically, the thermal valve 7 is constructed by bonding two slim metal plates having different thermal expansion coefficients together. As the two metal plates, for example, an iron plate and a copper plate are used. The thermal valve 7 undergoes deformation under heat application. When the heated thermal valve 7 becomes deformed so as to move away from the supply port 52, the supply port 52 in a closed state is opened, whereupon a gaseous fuel existing in the cavity of the casing 5 is fed to the heater through the supply port 52. On the other hand, when application of heat to the thermal valve 7 is stopped, the thermal valve 7 returns to its original shape free from deformation, whereupon the supply port 52 in an opened state is closed once again. The thermal valve 7 is mounted in the mount member 6. In a case of mounting the thermal valve 7 on the mount member 6, a region of the thermal valve 7 which is brought into contact with an inner surface of the casing 5 can be reduced. This makes it possible to suppress that deformation of the thermal valve 7 will be restrained due to the casing 5.

Figure 8:
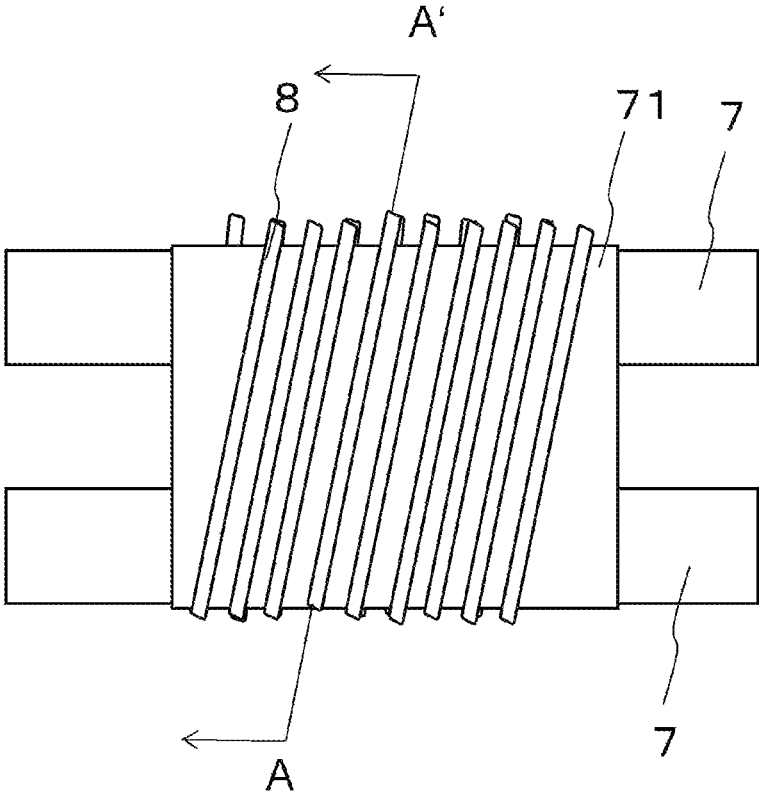
FIG. 8 is a schematic view showing a thermal valve which constitutes the gas valve shown in FIG. 7 and nearby regions.

The second heat-generating resistor 8 is a member for heating the thermal valve 7. The second heat-generating resistor 8 is constructed of a nichrome wire or the like. As shown in FIG. 8, the second heat-generating resistor 8 is disposed so as to be wound on part of the thermal valve 7. In a case where the second heat-generating resistor 8 is wound on the thermal valve 7, heat liberated from the second heat-generating resistor 8 can be transmitted to the thermal valve 7 satisfactorily. This helps reduce a period of time from the application of a voltage to the second heat-generating resistor 8 to the opening of the supply port 52 resulting from the deformation of the thermal valve 7. One end and the other end of the second heat-generating resistor 8 are connected to a pair of second lead terminals 9. Electric power is fed to the second heat-generating resistor 8 through the second lead terminals 9.

Figure 9:
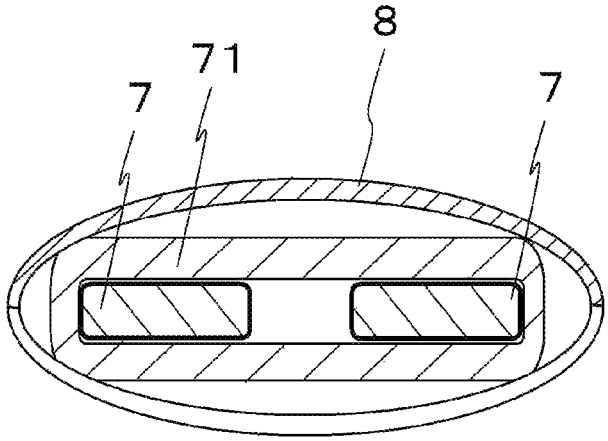
FIG. 9 is a sectional view of the thermal valve, a second heat-generating resistor, and a film taken along a plane passing through the line A-A' as shown in FIG. 8.

As shown in FIGS. 8 and 9, the second heat-generating resistor 8 is wound on the thermal valve 7, with a film 71 lying in between. The film 71 is a member for diffusively transmitting heat liberated from the second heat-generating resistor 8 to the thermal valve 7. The film 71 is disposed on the surface of the thermal valve 7 so as to surround the two metal plates in a direction intersecting with a longitudinal direction of the thermal valve 7. More specifically, a rectangular film 71 surrounds the two metal plates and a space between the two metal plates all together.

The film 71 is made of an insulating material. As the insulating material, for example, a heat-resistant resin or the like can be used. Specifically, as the heat-resistant resin, polyphenylene sulfide (PPS), polyimide (PI), polytetrafluoroethylene (PTFE), or the like can be used. Since the film 71 is brought into contact with the second heat-generating resistor 8 for use, it is desirable to adopt a heat-resistant resin as described above from the standpoint of long-term reliability. Moreover, in a case of forming the film 71 of an insulating material, the possibility of occurrence of short-circuiting in the second heat-generating resistor 8 can be decreased.

For example, the dimensions of the film 71 can be determined as follows. Specifically, the length of the film 71 in a direction parallel to the longitudinal direction of the thermal valve 7 can be set at 1.25 mm; the length thereof in a direction perpendicular to the aforementioned direction can be set at 1.35 mm; and the thickness thereof can be set at 0.45 mm.

The provision of the film 71 makes it possible to heat the surface of the thermal valve 7 over a wide range. In a case where the second heat-generating resistor 8 is simply wound directly on the thermal valve 7, a great temperature difference will arise between a part of the thermal valve 7 surface which makes contact with the second heat-generating resistor 8 and a part thereof which does not make contact with the second heat-generating resistor 8. In this regard, in a case where the film 71 is interposed between the second heat-generating resistor 8 and the thermal valve 7, heat liberated from the second heat-generating resistor 8 is transmitted to the film 71, and is whereafter diffused in the film 71. After that, the heat is transmitted from the film 71 to the surface of the thermal valve 7, wherefore a wider area of the surface of the thermal valve 7 can be heated. This makes it possible to reduce a degree of uneven distribution of heat occurring in the interior of the thermal valve 7, and thereby decrease the possibility of occurrence of distortion in the thermal valve 7.

The thickness of the film 71 may either be larger than or be smaller than a diameter of the second heat-generating resistor 8. The film 71 becomes capable of diffusing heat satisfactorily when the film 71 is given a larger thickness. On the other hand, in a case of imparting a smaller thickness to the film 71, the film 71 becomes deformed readily, and can therefore be wound tightly on the thermal valve 7 with ease. Accordingly, the adherability between the film 71 and the thermal valve 7 can be enhanced, wherefore an area of contact between the film 71 and the thermal valve 7 can be increased. As a result, heat can be transmitted from the film 71 to the thermal valve 7 over a wide range. This makes it possible to reduce a degree of uneven distribution of heat occurring in the interior of the thermal valve 7, and thereby decrease the possibility of occurrence of distortion in the thermal valve 7. In this case, the diameter of the second heat-generating resistor 8 can be set at 0.23 mm, and the thickness of the film 71 can be set at 0.1 mm.

Figure 10:
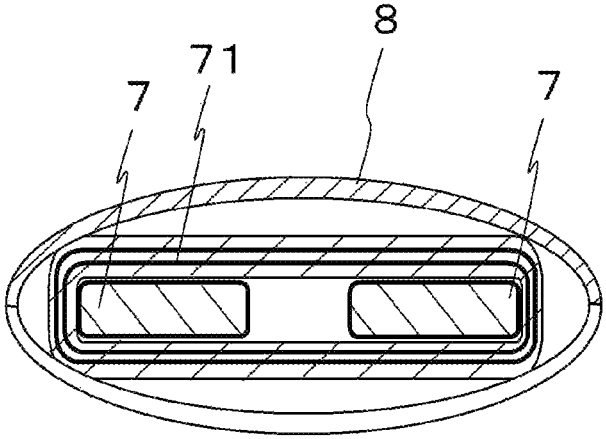
FIG. 10 shows a modified example of the thermal valve, the second heat-generating resistor, and the film shown in FIG. 9.

Although, in the gas valve 20 shown in FIG. 9, only a single layer of the film 71 is wound on the thermal valve 7, a structure of the gas valve 20 is not limited to such a structure. Specifically, as shown in FIG. 10, a plurality of films 71 may be wound in layers. In this case, the number of interfaces through which heat goes during travel of heat from the second heat-generating resistor 8 to the thermal valve 7 can be increased, wherefore the heat transmitted from the second heat-generating resistor 8 to the film 71 spreads more readily in a planar direction of the film 71 than in the thickness direction of the film 71. This makes it possible to reduce a degree of uneven distribution of heat occurring in the interior of the thermal valve 7, and thereby decrease the possibility of occurrence of distortion in the thermal valve 7.

The second lead terminals 9 are an electrically conductive member for connecting the second heat-generating resistor 8 to an external electrode. The second lead terminals 9 are disposed on the outer surface of the casing 5. The second lead terminals 9 are electrically connected to the second heat-generating resistor 8. The second lead terminals 9 are made of a metal material such for example as copper or brass. The second lead terminals 9 and the casing 5 are electrically isolated from each other by a mica or the like. The joining together of the second lead terminals 9 and the second heat-generating resistor 8 is accomplished by means of spot welding or pressure bonding, for example.

Figure 11:
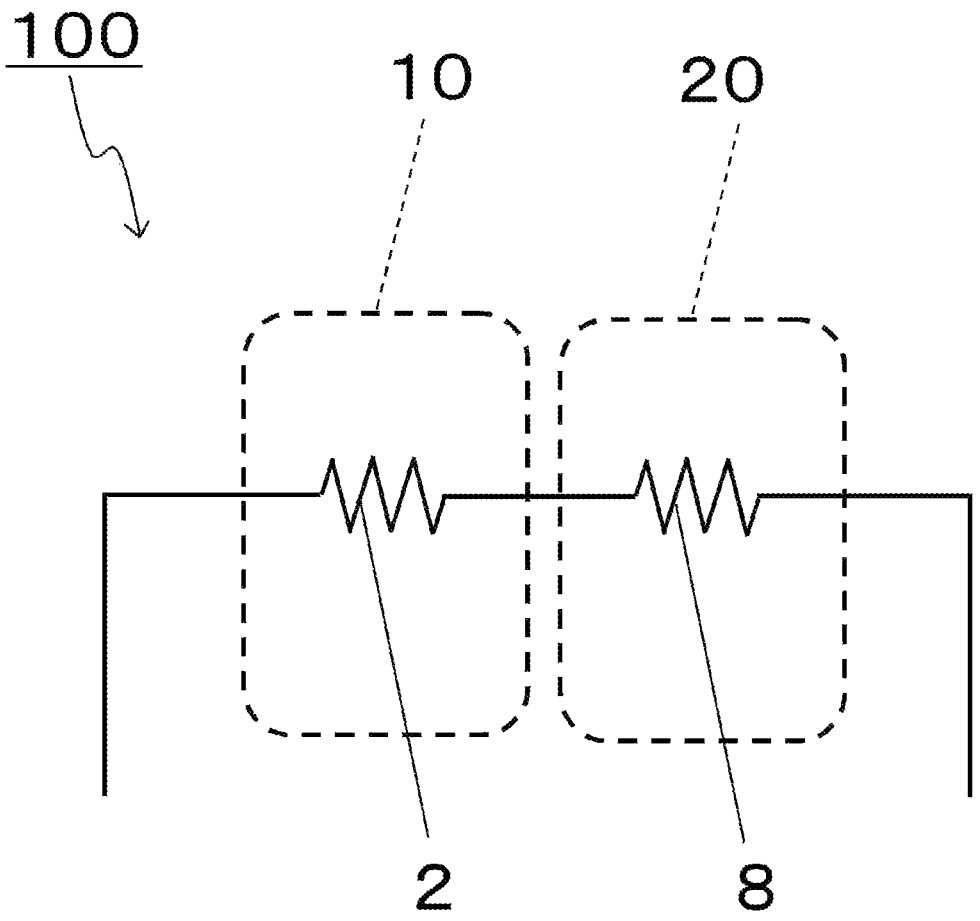
FIG. 11 is a circuit diagram showing a connection relationship between the heater shown in FIG. 1 and the gas valve shown in FIG. 7.

Next, the relationship between the heater 10 and the gas valve 20 will be described from the standpoint of electrical aspect. As shown in FIG. 11, the first heat-generating resistor 2 of the heater 10 and the second heat-generating resistor 8 of the gas valve 20 are electrically connected in series with each other. Specifically, for example, one of the first lead terminals 3 is connected to a positive electrode of the power supply, whereas the other one of the first lead terminals 3 is connected to one of the second lead terminals 9, and, the other one of the second lead terminals 9 is connected to a negative electrode of the power supply. In this way, the supply of a gaseous fuel and the heat generation of the heater 10 can be controlled by the same power supply and a single switch. This helps simplify electric circuitry in an ignition apparatus 100.

Moreover, in a comparison of the first heat-generating resistor 2 with the second heat-generating resistor 8, the resistance (resistance value) of the first heat-generating resistor 2 at a room temperature is greater than the resistance (resistance value) of the second heat-generating resistor 8, and the temperature coefficient of resistance of the first heat-generating resistor 2 is larger than the temperature coefficient of resistance of the second heat-generating resistor 8. Thus, even if the difference in resistance (resistance value) between the first heat-generating resistor 2 and the second heat-generating resistor 8 is small at the time of starting of voltage application, the proportion of a voltage drop in the first heat-generating resistor 2 to the overall voltage drop with respect to the applied voltage is increased as time elapses. Accordingly, the difference in resistance (resistance value) between the first heat-generating resistor 2 and the second heat-generating resistor 8 at the instant at which a voltage is applied to the first heat-generating resistor 2 of the heater 10 and the second heat-generating resistor 8 of the gas valve 20 can be set at a smaller value. This makes it possible to allow the second heat-generating resistor 8 to produce heat satisfactorily, and thereby heat the thermal valve 7 satisfactorily. Thus, the supply of a gaseous fuel from the gas valve 20 to the heater 10 can be accomplished in a short period of time since voltage application is started. As a result, the ignition apparatus 100 is capable of igniting the gaseous fuel in a short period of time. Note that the resistance of the first heat-generating resistor 2 can be set in a range of 0.2 to 100Ω, for example. Moreover, the temperature coefficient of resistance of the first heat-generating resistor 2 can be set in a range of 500 to 4000 ppm. On the other hand, the resistance of the second heat-generating resistor 8 can be set in a range of 0.1 to 40Ω, for example. Moreover, the temperature coefficient of resistance of the second heat-generating resistor 8 can be set in a range of 0 to 3000 ppm.

Moreover, it is desirable that the temperature coefficient of resistance of the first heat-generating resistor 2 is greater than 0. In a case where the temperature coefficient of resistance of the first heat-generating resistor 2 is greater than 0, that is, a positive value, the resistance (resistance value) of the first heat-generating resistor 2 at a room temperature can be set to be smaller than a resistance of a level required for the first heat-generating resistor 2 to produce heat adequately during gaseous fuel combustion. Accordingly, the difference in resistance between the first heat-generating resistor 2 and the second heat-generating resistor 8 at the time of starting of voltage application can be further decreased. This makes it possible to allow the second heat-generating resistor 8 to produce heat satisfactorily, and thereby heat the thermal valve 7 satisfactorily. Thus, the supply of a gaseous fuel from the gas valve 20 to the heater 10 can be accomplished in a short period of time since voltage application is started.

Moreover, it is preferable that the temperature coefficient of resistance of the second heat-generating resistor 8 is greater than 0. In this case, the resistance (resistance value) of the second heat-generating resistor 8 at the time of starting of voltage application can be set at a small value. This makes it possible to allow passage of a larger amount of electric current at the time of starting of voltage application, and thereby increase the quantity of heat produced in the second heat-generating resistor 8. As a result, the thermal valve 7 can be heated more satisfactorily.

Moreover, it is preferable that the first heat-generating resistor 2 is obtained by arranging electrically continuous conductive ceramics in insulating ceramics. Specifically, it is preferable that particles of electrically conductive ceramics are arranged contiguously in insulating ceramics. At this time, the temperature coefficient of resistance of the first heat-generating resistor 2 can be adjusted easily by varying the proportion of the conductive ceramics in the insulating ceramics. In a case of using tungsten carbide as the conductive ceramics, for example, silicon nitride or boron nitride can be used as the insulating ceramics. It is particularly preferable to adopt tungsten carbide as the conductive ceramics, as well as to adopt silicon nitride as the insulating ceramics. In this case, the durability of the first heat-generating resistor 2 can be enhanced.

Moreover, it is preferable that the insulating ceramics constituting the first heat-generating resistor 2 is identical with a ceramic material for forming the insulating substrate 1. In this case, the coefficient of thermal expansion of the first heat-generating resistor 2 can be approximated to the coefficient of thermal expansion of the insulating substrate 1. This makes it possible to reduce a thermal stress which is developed in the first heat-generating resistor 2 when the first heat-generating resistor 2 produces heat.

Figure 12:
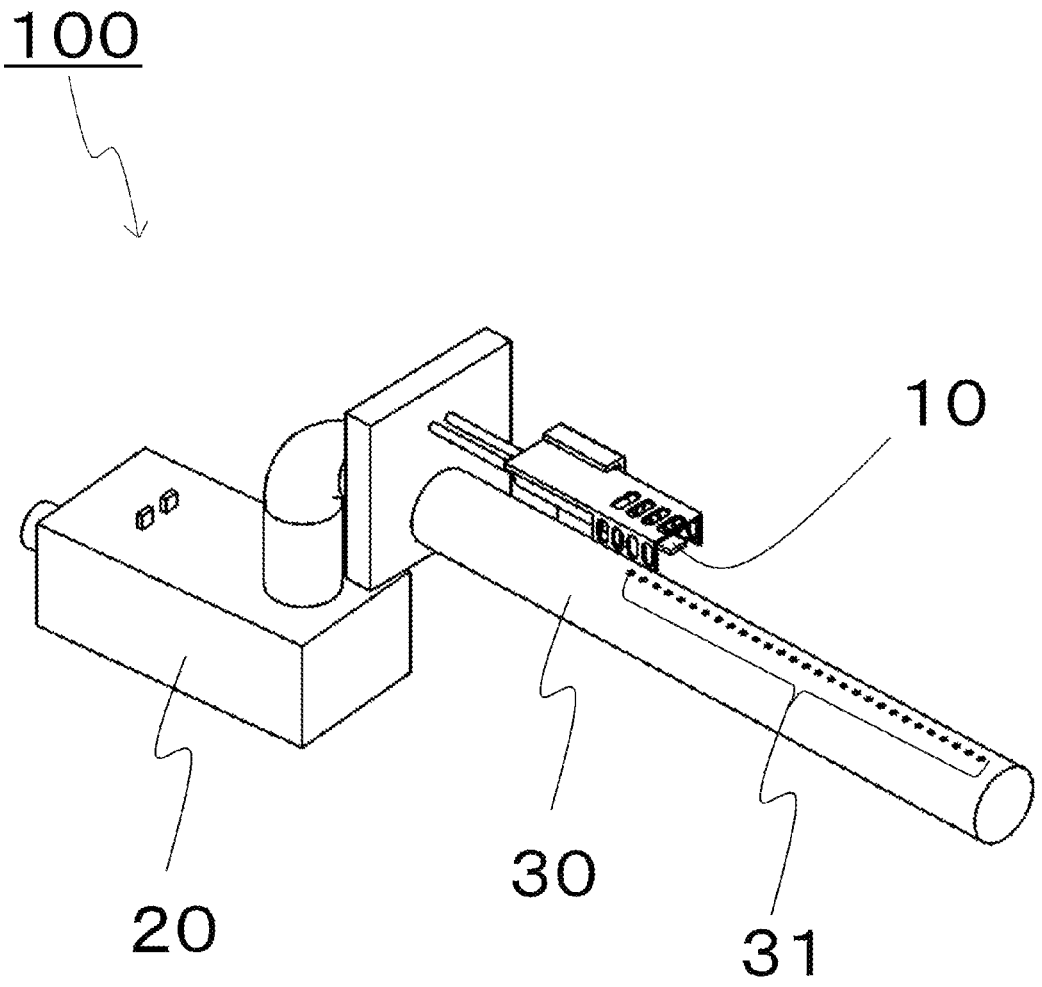
FIG. 12 is a schematic view showing the ignition apparatus as a whole.

The heater 10 and the gas valve 20 are used in the form of the ignition apparatus 100 as shown in FIG. 12, for example. The heater 10 and the gas valve 20 are connected to each other by a vent pipe 30. The vent pipe 30 is made of a metal material such for example as steel or aluminum. The vent pipe 30 functions as a flow channel for the passage of a gaseous fuel. An end of the vent pipe 30 is attached to the supply port 52 of the gas valve. Moreover, the vent pipe 30 has a plurality of holes 31 located in the vicinity of the heater 10, for ejecting a gaseous fuel toward the heater 10. The plurality of holes 31 are arranged along a longitudinal direction of the vent pipe 30. A gaseous fuel fed from the supply port 52 of the gas valve is ejected from the plurality of holes 31 toward the heater 10. The gaseous fuel ejected from, out of the plurality of holes 31, the one located near the heater 10 is ignited by the heater 10. Once fuel ignition is effected, parts of the gaseous fuel ejected from other holes 31 are ignited one after another, so that all of parts of the gaseous fuel ejected from the plurality of holes 31 can be ignited. In consequence, flame spreads out to a region spaced away from the heater 10, wherefore the ignition apparatus 100 can be applied to a large-sized gas range, for example.

At this time, the heater 10 is placed so that the warped surface of the insulating substrate 1 faces the plurality of holes 31. In this way, as has already been described, ignition can be facilitated by virtue of the warpage of the insulating substrate 1. Moreover, the longitudinal direction of the insulating substrate 1 may be aligned with an arrangement direction of the plurality of holes 31, and the insulating substrate 1 may be warped in the longitudinal direction thereof. In this case, the gaseous fuel sprayed on the insulating substrate 1 is allowed to flow smoothly over the insulating substrate along the arrangement direction of the plurality of holes 31, wherefore parts of the gaseous fuel ejected from different holes 31 of the plurality of holes 31 can be ignited readily.

REFERENCE SIGNS LIST

1: Insulating substrate
2: Heat-generating resistor (first heat-generating resistor)
3: First lead terminal
5: Casing
51: Admission port
52: Supply port
6: Mount member
7: Thermal valve
8: Second heat-generating resistor
9: Second lead terminal
10: Heater
20: Gas valve
71: Film
30: Vent pipe
31: Hole
100: Ignition apparatus

What is claimed is:

1. A heater, comprising:

an insulating substrate having a rectangular parallelpiped shape; and a heat-generating resistor embedded inside the insulating substrate so as to extend in a longitudinal direction thereof, the insulating substrate comprising opposite surfaces to each other, one of the opposite surfaces being a convexly curved surface which is convex along the longitudinal direction or a width direction thereof, the other of opposite surfaces being a concavely curved surface which is concave corresponding to the convexly curved surface.

2. The heater according to claim 1, wherein the one of the opposite surfaces of the insulating substrate is a convexly curved surface which is convex along both of the longitudinal direction and the width direction thereof, and the other of the opposite surfaces of the insulating substrate is a concavely curved surface which is concave corresponding to the convexly curved surface.

3. The heater according to claim 1, wherein the insulating substrate is composed of silicon nitride ceramics.

4. An ignition apparatus, comprising:

an insulating substrate having a rectangular parallelepiped shape, the insulating substrate comprising opposite surfaces to each other, one of the opposite surfaces being a convexly curved surface which is convex along a longitudinal direction or a width direction thereof, the other of the opposite surfaces being a concavely curved surface which is concave corresponding to the convexly curved surface;

a heat-generating resistor embedded inside the insulating substrate so as to extend in the longitudinal direction thereof; and a flow channel for passing a gaseous fuel toward the convexly curved surface or the concavely curved surface of the insulating substrate.

5. The heater according to claim 4, wherein the one of the opposite surfaces of the insulating substrate is a convexly curved surface which is convex along both of the longitudinal direction and the width direction thereof, and the other of the opposite surfaces of the insulating substrate is a concavely curved surface which is concave corresponding to the convexly curved surface.

6. An ignition apparatus, comprising:

an insulating substrate having a rectangular parallelepiped shape, the insulating substrate comprising opposite surfaces to each other, one of the opposite surfaces being a convexly curved surface which is convex along a longitudinal direction or a width direction thereof, the other of the opposite surfaces being a concavely curved surface which is concave corresponding to the convexly curved surface;

a heat-generating resistor embedded inside the insulating substrate so as to extend in the longitudinal direction thereof; and a vent pipe having a plurality of holes for spraying a gaseous fuel toward the convexly curved surface or the concavely curved surface of the insulating substrate.

7. The ignition apparatus according to claim 6, wherein the longitudinal direction of the insulating substrate is aligned with an arrangement direction of the plurality of holes, and wherein the one of the opposite surfaces of the insulating substrate is a convexly curved surface which is convex along the longitudinal direction thereof, and the other of the opposite surfaces is a concavely curved surface which is concave corresponding to the convexly curved surface.

* * * * *